US008815062B2

(12) United States Patent
Asou et al.

(10) Patent No.: US 8,815,062 B2
(45) Date of Patent: Aug. 26, 2014

(54) PLATING PRETREATMENT APPARATUS AND METHOD FOR MULTI-CYLINDER BLOCK

(75) Inventors: Tomohiro Asou, Shizuoka-Ken (JP); Seiya Kunioka, Hamamatsu (JP); Hitoshi Muramatsu, Hamamatsu (JP); Nobuyuki Suzuki, Toyohashi (JP); Naoyuki Suda, Hamamatsu (JP); Akira Ishibashi, Hamamatsu (JP); Minoru Imai, Iwata (JP); Manabu Suzuki, Hamamatsu (JP); Masahiro Ogawa, Hamamatsu (JP)

(73) Assignee: Suzuki Motor Corporation, Hamamatsu-Shi, Shizuoka-Ken (JP)

( * ) Notice: Subject to any disclaimer, the term of this patent is extended or adjusted under 35 U.S.C. 154(b) by 918 days.

(21) Appl. No.: 12/604,925

(22) Filed: Oct. 23, 2009

(65) Prior Publication Data

US 2010/0104738 A1 Apr. 29, 2010

(30) Foreign Application Priority Data

Oct. 24, 2008 (JP) ..... 2008-273865

(51) Int. Cl.

| | |
|---|---|
| ***C25D 17/00*** | (2006.01) |
| ***C25D 7/04*** | (2006.01) |
| ***C25D 17/06*** | (2006.01) |
| ***C25D 7/00*** | (2006.01) |
| ***C25F 7/00*** | (2006.01) |
| ***C25D 21/12*** | (2006.01) |
| *C25D 5/08* | (2006.01) |
| *C25D 21/02* | (2006.01) |

(52) U.S. Cl.

CPC ... *C25F 7/00* (2013.01); *C25D 7/04* (2013.01); *C25D 17/06* (2013.01); *C25D 7/00* (2013.01); *C25D 5/08* (2013.01); *C25D 21/12* (2013.01); *C25D 17/00* (2013.01); *C25D 21/02* (2013.01)

USPC ..... 204/227; 205/131

(58) Field of Classification Search

USPC ..... 204/227; 205/131

See application file for complete search history.

(56) References Cited

U.S. PATENT DOCUMENTS

| | | | | |
|---|---|---|---|---|
| 5,468,295 | A * | 11/1995 | Marantz et al. | 118/723 DC |
| 5,647,967 | A * | 7/1997 | Murase et al. | 205/131 |
| 5,660,704 | A * | 8/1997 | Murase | 205/109 |
| 5,810,990 | A * | 9/1998 | Ikegaya | 205/122 |
| 2001/0040090 | A1 * | 11/2001 | Kuroda et al. | 204/272 |
| 2004/0211672 | A1 * | 10/2004 | Ishigami et al. | 205/131 |
| 2008/0047829 | A1 * | 2/2008 | Ogawa et al. | 204/275.1 |

FOREIGN PATENT DOCUMENTS

| | | |
|---|---|---|
| JP | 9-3687 | 1/1997 |
| JP | 2002-91593 | 3/2002 |

* cited by examiner

*Primary Examiner* — Bryan D. Ripa

(74) *Attorney, Agent, or Firm* — Barnes & Thornburg LLP

(57) ABSTRACT

A plating pretreatment apparatus for a multi-cylinder block includes a plurality of cylinders that performs a plating pretreatment of a cylinder inner wall surface of each of the cylinders using an electrode disposed so as to oppose to the cylinder inner wall surface by sealing one end of the cylinder inner wall surface and introducing a treatment liquid to the cylinder inner wall surface. In such plating pretreatment apparatus, at least one of a power supply device that supplies electricity to the cylinder block and the electrode and a liquid feed pump that feeds the treatment liquid into a gap between the cylinder inner wall surface and the electrode is provided for each of the cylinders.

6 Claims, 9 Drawing Sheets

PLATING PRETREATMENT APPARATUS AND METHOD FOR MULTI-CYLINDER BLOCK

CROSS-REFERENCE TO RELATED APPLICATION(S)

This United States Non-Provisional Utility Patent Application claims priority to and relies for priority upon Japanese Patent Application No. 273865/2008, which was filed on Oct. 24, 2008, the contents of which are incorporated herein by reference.

BACKGROUND OF THE INVENTION

1. Field of the Invention

The present invention relates to a plating pretreatment apparatus and a plating treatment method for a multi-cylinder block, and particularly, to a plating pretreatment apparatus and method that can individually control flow rate of a treatment liquid supplied to and the current and voltage applied to each of a plurality of cylinders of a multi-cylinder block.

2. Description of the Related Art

There are methods and apparatuses that perform a plating pretreatment of a cylinder inner wall surface of each of a plurality of cylinders of a multi-cylinder block. The plating pretreatment involves a chemical reaction, and therefore, temperature control is highly important to uniformly achieve the plating pretreatment.

For example, the plating pretreatment method and apparatus described in Patent Document 1 (Japanese Patent Laid-Open No. 9-3687) use a heater inserted in each cylinder and perform a plating pretreatment of the cylinder inner wall surface of each cylinder while heating the treatment liquid in the cylinder by controlling the temperature of the heater.

However, in the case where the plating pretreatment includes an electrochemical etching treatment that involves circulation of the treatment liquid, there causes an inconvenience that an electrode and a piping jig are placed in the cylinder, so that the cylinder cannot accommodate the heater, and therefore, the temperature control is impracticable.

In addition, according to Patent Document 1, four cylinders contain heaters, respectively, and the four heaters are controlled by a single temperature controller. Thus, the temperature of the heater may vary among the cylinders, and as a result, the plating pretreatment may be non-uniform among the cylinders.

Furthermore, according to Patent Document 1, what is controlled is not the temperature of the treatment liquid but the temperature of the heaters. Therefore, in the case where the cylinders are cold and draw much heat from the treatment liquid, a significant temperature difference may occur between the heaters and the treatment liquid, resulting in inappropriate heating of the treatment liquid even if the temperature of the heaters is controlled.

SUMMARY OF THE INVENTION

The present invention was conceived in consideration of the circumstances encountered in the prior art mentioned above and an object of the present invention is to provide a plating pretreatment apparatus and a plating treatment method for a multi-cylinder block that can perform a uniform plating pretreatment of a cylinder inner wall surface of each of a plurality of cylinders.

The above and other objects can be achieved according to the present invention by providing, in one aspect, a plating pretreatment apparatus for a multi-cylinder block having a plurality of cylinders that performs a plating pretreatment of a cylinder inner wall surface of each of the cylinders using an electrode disposed so as to oppose to the cylinder inner wall surface by sealing one end of the cylinder inner wall surface and introducing a treatment liquid to the cylinder inner wall surface, wherein at least one of a power supply device that supplies electricity to the cylinder block and the electrode and a liquid feed pump that feeds the treatment liquid into a gap between the cylinder inner wall surface and the electrode is provided for each of the cylinders.

In this aspect, the following preferred exemplary embodiments may be provided.

It may be desired that the power supply device measures the current or voltage supplied to the cylinder block and the electrode housed in each of the cylinders and controls the current or voltage to be supplied based on the measurement value in the plating pretreatment.

A controller may be further disposed that controls the flow rate of the treatment liquid fed by the liquid feed pump based on a measurement value of an outlet temperature of the treatment liquid flowing out of each of the cylinders in the plating pretreatment.

The controller may be configured to previously set the value of the current or voltage supplied from the power supply device and the value of the flow rate of the treatment liquid fed by the liquid feed pump for each cylinder. Further, the controller may be configured to identify a cylinder that involves an abnormality occurring in the current or voltage supplied from the power supply device or the flow rate of the treatment liquid fed by the liquid feed pump and stop the plating pretreatment of the cylinder that involves the abnormality while continuing the plating pretreatment of the other cylinders.

A treatment liquid tank that stores the treatment liquid may be further provided for each cylinder.

In another aspect of the present invention, there is also provided a plating pretreatment method for a multi-cylinder block having a plurality of cylinders that performs a plating pretreatment of a cylinder inner wall surface of each of the cylinders using an electrode disposed so as to oppose to the cylinder inner wall surface by sealing one end of the cylinder inner wall surface and introducing a treatment liquid to the cylinder inner wall surface, wherein at least one of the current or voltage supplied to the cylinder block and the electrode and the flow rate of the treatment liquid fed into a gap between the cylinder inner wall surface and the electrode is adjusted for each of the cylinders.

In the above plating pretreatment method, it may be desired that the current or voltage supplied to the cylinder block and the electrode housed in each of the cylinders is measured, and the current or voltage to be supplied is controlled based on the measurement value in the plating pretreatment.

It may be desired that an outlet temperature of the treatment liquid flowing out of each of the cylinders is measured, and the flow rate of the treatment liquid fed by a liquid feed pump is controlled based on the measurement value in the plating pretreatment.

It may be desired that the value of the current or voltage supplied from a power supply device and the value of the flow rate of the treatment liquid fed by a liquid feed pump are previously set for each cylinder.

It may be desired that when an abnormality occurs in the current or voltage supplied from a power supply device or the flow rate of the treatment liquid fed by a liquid feed pump, the plating pretreatment of the cylinder involved with the abnormality is stopped, the plating pretreatment of the other cylinders is continued and completed, and thereafter, the plating pretreatment of the cylinder involved with the abnormality is performed again.

In a further aspect, the present invention may provides a plating pretreatment apparatus for a multi-cylinder block, comprising:

an apparatus body including a work mount on which a cylinder block is mounted;

an electrode supported by an electrode support provided for the apparatus body;

a treatment liquid supply member for supplying a treatment liquid in a gap formed between a cylinder inner wall surface and an outer wall surface of the electrode and in an inside of the cylindrical electrode, the treatment liquid supply member including a liquid feed pump;

a power supply member for flowing electricity to the electrode and the cylinder block; and a seal member for sealing one end side of the cylinder inner wall surface, wherein at least one of the power supply member and a liquid feed pump that feeds the treatment liquid into a gap between the cylinder inner wall surface and the electrode is provided for each of the cylinders.

A controller may be further disposed that controls the flow rate of the treatment liquid fed by the liquid feed pump based on a measurement value of an outlet temperature of the treatment liquid flowing out of each of the cylinders in the plating pretreatment.

According to the plating pretreatment apparatus and method for a multi-cylinder block of the present invention of the characters mentioned above, the current or voltage can be adjusted for each cylinder by the power supply device provided for each cylinder, and the flow rate of the treatment liquid can be adjusted for each cylinder by the liquid feed pump provided for each cylinder. Therefore, even when the electrical resistance or resistance of the treatment liquid flow path varies among the cylinders, the plating pretreatment of the cylinder inner wall surfaces of the plurality of cylinders can be uniformly performed.

The nature and further characteristic features will be made clearer from the following descriptions made with reference to the accompanying drawings.

BRIEF DESCRIPTION OF THE DRAWINGS

In the accompanying drawings:

FIG. 4 includes cross-sectional views of a seal jig shown in FIG. 3, in which

DESCRIPTION OF THE PREFERRED EMBODIMENTS

In the following, an embodiment of the present invention will be described with reference to the drawings. Further, in the following description, terms "upper", "lower", "right", "left" and like terms are used herein with reference to the illustrations of the drawings.

Figure 1:
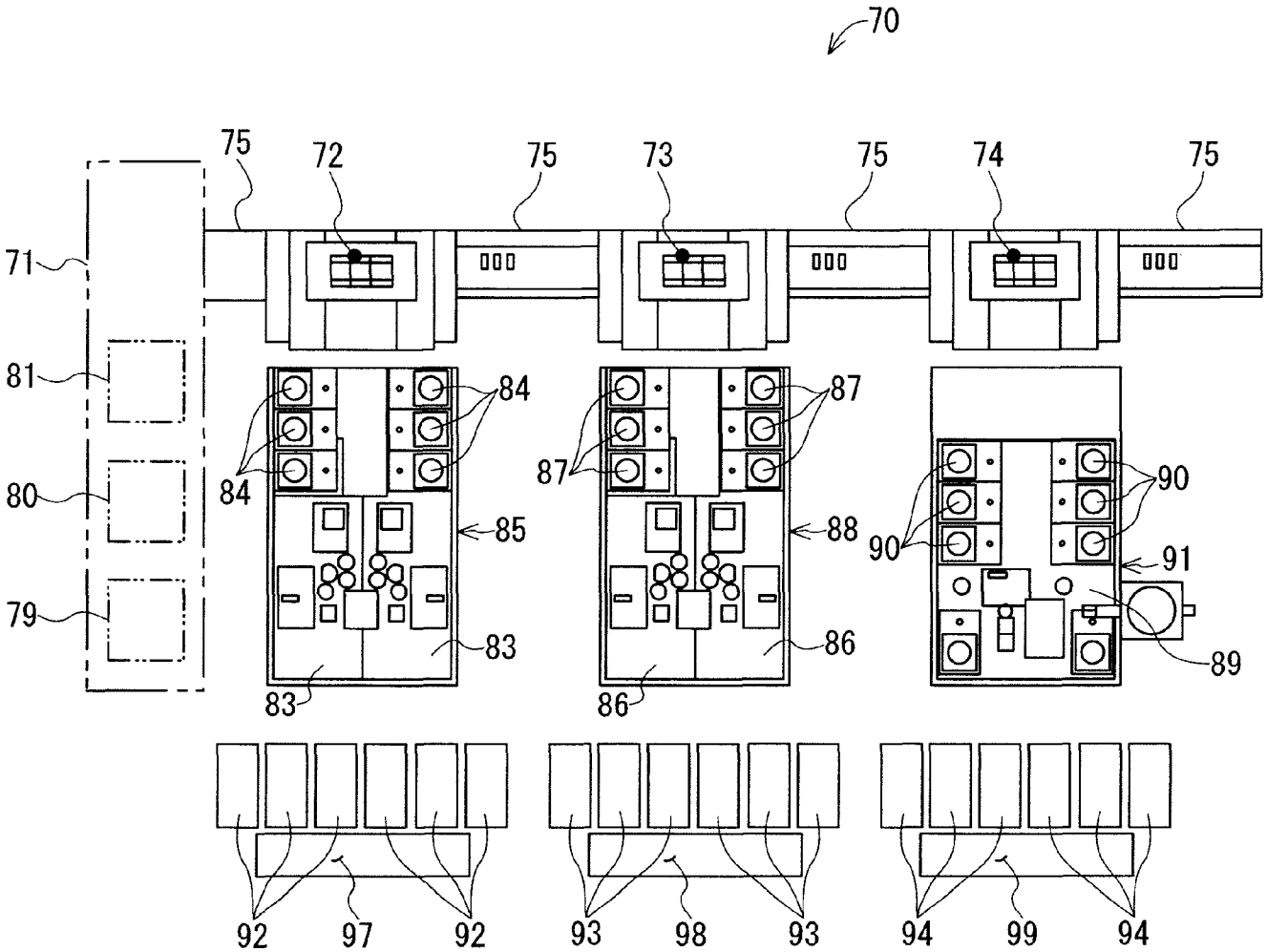
FIG. 1 is a plan view of a plating treatment line including a plating pretreatment apparatus for a multi-cylinder block according to an embodiment of the present invention.
Figure 2:
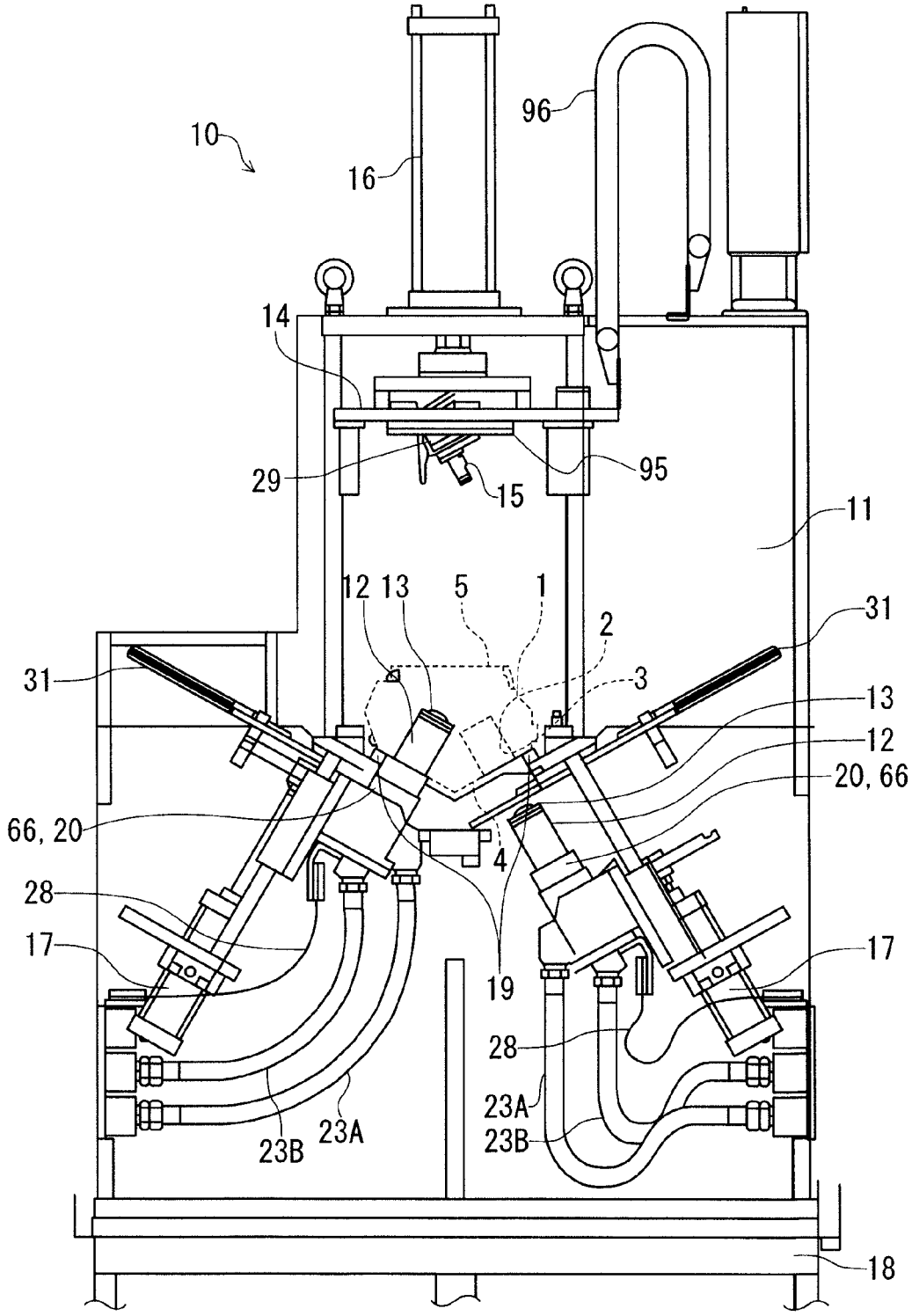
FIG. 2 is a front view of the whole of a treatment apparatus that serves as the plating pretreatment apparatus shown in FIG. 1 and also serves as a plating apparatus.

With reference to FIGS. 1 and 2, a plating treatment line 70 shown in FIG. 1 is an equipment or installation that performs a plating pretreatment and a plating treatment of a cylinder inner wall surface 3 of each of a plurality of (six, for example) cylinders 2 of a cylinder block 1 (a V-type multi-cylinder (6-cylinder, for example) cylinder block in this embodiment) of an engine shown in FIG. 2.

The plating treatment line 70 includes a plurality of plating pretreatment apparatuses or units (specifically, a degreasing cleaning apparatus 71, an electrolytic etching apparatus 72 and an anodic oxidizing apparatus 73), a plating apparatus 74 and roller conveyors 75 serving as a transport conveyor.

In the plating treatment line 70, the degreasing cleaning apparatus 71 is disposed upstream of the electrolytic etching apparatus 72, which is disposed upstream of the anodic oxidizing apparatus 73, which is disposed upstream of the plating apparatus 74.

The roller conveyors 75 are disposed between the degreasing cleaning apparatus 71 and the electrolytic etching apparatus 72, between the electrolytic etching apparatus 72 and the anodic oxidizing apparatus 73, and between the anodic oxidizing apparatus 73 and the plating apparatus 74, for example.

The degreasing cleaning apparatus 71 is a treatment apparatus that immerses the cylinder block 1 in a treatment liquid to achieve degreasing or other treatment. To the contrary, the electrolytic etching apparatus 72, the anodic oxidizing apparatus 73 and the plating apparatus 74 are treatment apparatuses that circulate a treatment liquid through the cylinders 2 of the cylinder block 1 so that only the cylinder inner wall surfaces 3 of the cylinders 2 are subjected to the electrolytic etching treatment, the anodic oxidation treatment and the plating treatment.

More specifically, in the degreasing cleaning apparatus 71, the cylinder block 1 is held by a workpiece chuck or other gripping member, not shown, and sequentially immersed in a degreasing tank 79, a cleaning tank 80 and a preliminary heating tank 81. By immersing the cylinder block 1 in the degreasing tank 79, oil content and contaminant on the cylinder block 1 are removed. By immersing the cylinder block 1 in the cleaning tank 80, the cylinder block is cleaned. By immersing the cylinder block 1 in the preliminary heating tank 81, the entire cylinder block 1 is uniformly heated to a predetermined temperature.

The electrolytic etching apparatus 72 includes a treatment liquid reservoir 85 provided with two chemical tanks 83 and a plurality of (six, for example) liquid feed pumps 84 and a plurality of (six, for example) power supply devices 92. The treatment liquid reservoir 85 and the power supply devices 92 are disposed adjacent to each other. Each power supply device 92 and each liquid feed pump 84 are associated with a corresponding one of the plurality of cylinders 2 of the cylinder block 1. Reference numeral 97 denotes a controller that controls the electrolytic etching apparatus 72.

The electrolytic etching apparatus 72 performs an electrolytic etching treatment to enhance the adhesion of the plating by removing impurities or oxide films on the cylinder inner wall surfaces 3 and etching the cylinder inner wall surfaces 3 by a predetermined amount to make the cylinder inner wall surfaces 3 coarse by introducing the treatment liquid (a phosphoric acid solution serving as a plating pretreatment liquid, for example) from the chemical tanks 83 only to the cylinder inner wall surfaces 3 of the cylinders 2 of the cylinder block 1 by means of the liquid feed pumps 84 and supplying an electric power from the power supply devices 92.

The two chemical tanks 83 are provided in order to prevent the electrolytic etching treatment form being interrupted. That is, while one of the two chemical tanks 83 is refilled with fresh treatment liquid, the other tank is used for the electrolytic etching treatment.

The anodic oxidizing apparatus 73 includes a treatment liquid reservoir 88 provided with two chemical tanks 86 and a plurality of (six, for example) liquid feed pumps 87 and a plurality of (six, for example) power supply devices 93. The treatment liquid reservoir 88 and the power supply devices 93 are disposed adjacent to each other. Each power supply device 93 and each liquid feed pump 87 are associated with a corresponding one of the plurality of cylinders 2 of the cylinder block 1. Reference numeral 98 denotes a controller that controls the anodic oxidizing apparatus 73.

The anodic oxidizing apparatus 73 performs an anodic oxidation treatment to enhance the adhesion of the plating by forming a porous oxide film on the cylinder inner wall surfaces 3 by introducing the treatment liquid (for example, a phosphoric acid solution serving as a plating pretreatment liquid) from the chemical tanks 86 only to the cylinder inner wall surfaces 3 of the cylinders 2 of the cylinder block 1 by means of the liquid feed pumps 87 and supplying an electric power from the power supply devices 93. The two chemical tanks 86 are provided in order to prevent the anodic oxidation treatment form being interrupted. That is, while one of the two chemical tanks 86 is refilled with fresh treatment liquid, the other tank is used for the anodic oxidation treatment.

The plating apparatus 74 includes a treatment liquid reservoir 91 is provided with one chemical tank 89 and a plurality of (six, for example) liquid feed pumps 90 and a plurality of (six, for example) power supply devices 94. The treatment liquid reservoir 91 and the power supply devices 94 are disposed adjacent to each other. Each power supply device 94 and each liquid feed pump 90 are associated with a corresponding one of the plurality of cylinders 2 of the cylinder block 1. Reference numeral 99 denotes a controller that controls the plating apparatus 74.

The plating apparatus 74 performs a plating treatment to form a plating film (a nickel plating film, for example) on the cylinder inner wall surfaces 3 by introducing the treatment liquid (a nickel sulfate plating solution serving as a plating solution, for example) from the chemical tank 89 only to the cylinder inner wall surfaces 3 of the cylinders 2 of the cylinder block 1 by means of the liquid feed pumps 90 and supplying an electric power from the power supply devices 94.

The chemical tanks 83 of the treatment liquid reservoir 85, the chemical tanks 86 of the treatment liquid reservoir 88 and the chemical tank 89 of the treatment liquid reservoir 91 are the same as a chemical tank 25 (FIG. 3) described hereinlater, and the liquid feed pumps 84 of the treatment liquid reservoir 85, the liquid feed pumps 87 of the treatment liquid reservoir 88 and the liquid feed pumps 90 of the treatment liquid reservoir 91 are also the same as a liquid feed pump 24 (FIG. 3) described hereinlater.

Furthermore, the power supply devices 92, 93 and 94 are the same as a power supply device 30 described hereinlater, and the controllers 97, 98 and 99 are the same as a controller 62 described hereinlater.

In the following, a treatment apparatus 10 serving as the electrolytic etching apparatus 72, the anodic oxidizing apparatus 73 and the plating apparatus 74 will be described with reference to FIGS. 2 to 4.

The treatment apparatus 10 shown in FIG. 2 comprises an apparatus main unit 11, an electrode 12, a seal jig 13, a workpiece holding jig 14, an air joint 15, a clamp cylinder 16 and an electrode cylinder 17. The treatment apparatus 10 seals one end of a cylinder inner wall surface 3 closer to a crankcase surface 5 of a cylinder block 1 of an engine with the seal jig 13, introduces a treatment liquid (a plating pretreatment liquid or a plating solution) to the cylinder inner wall surface 3, and uses the electrode 12 (FIG. 3) positioned to oppose to the cylinder inner wall surface 3 so as to perform a treatment (a plating pretreatment or a plating treatment) of the cylinder inner wall surface 3 in a short time.

Figure 6:
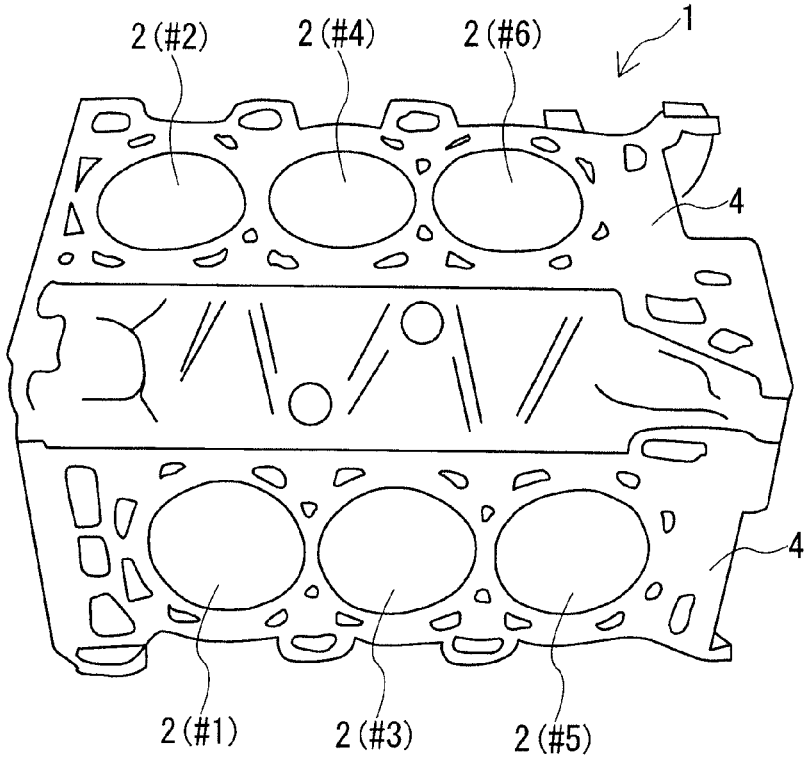
FIG. 6 is a perspective view of the cylinder block shown in FIG. 2.

According to this embodiment, the cylinder block 1 is a V-type multi-cylinder (6-cylinder) block comprising a plurality of (six, for example) cylinders 2, as shown in FIG. 6. The plurality of cylinders 2 is disposed at a predetermined angle in the cylinder block 1, and the treatment apparatus 10 performs the plating pretreatment or plating treatment of the cylinder inner wall surfaces 3 of the cylinders 2 at the same time.

As shown in FIG. 2, the apparatus main unit 11 of the treatment apparatus 10 is placed on and fixed to a pedestal 18 and has a workpiece mount 19 on which the cylinder block 1 is mounted. The cylinder block 1 is mounted on the workpiece mount 19 with a head surface 4 directed downward.

In the apparatus main unit 11, the workpiece holding jig 14 capable of being lifted and lowered by the clamp cylinder 16 is installed above the workpiece mount 19. The workpiece holding jig 14 has a conducting plate 95 and a clamp, not shown. The conducting plate 95 abuts against the crankcase surface 5 of the cylinder block 1 mounted on the workpiece mount 19 when the workpiece holding jig 14 is at a lowered position. At this position, the clamp of the workpiece holding jig 14 grips a portion of the cylinder block 1 close to the crankcase surface 5, and thus, the cylinder block 1 is held between the workpiece mount 19 and the workpiece holding jig 14 with the conducting plate 95 being interposed between the workpiece holding jig 14 and the cylinder block 1.

The electrode 12 is supported by an electrode supporting section 20, and the electrode supporting section 20 is attached to the electrode cylinder 17 installed in the apparatus main unit 11. When the electrode cylinder 17 moves forward, the electrode 12 is inserted into the cylinder 2 of the cylinder block 1 from the end of the cylinder inner wall surface 3 closer to the head surface 4, and when the electrode cylinder 17 moves backward, the electrode 12 is retracted from the cylinder 2. In FIG. 2, the left-hand electrode 12 takes an inserted position, and the right-hand electrode 12 takes a retracted position. When the electrode 12 is inserted into the cylinder 2 of the cylinder block 1, a seal ring 21 (FIG. 3), such as a silicon rubber sheet, mounted on a flow channel block 66 comes into contact with the head surface 4 of the cylinder block 1 to seal the end of the cylinder inner wall surface 3 closer to the head surface 4, which is the other end of the cylinder inner wall surface 3.

The flow channel block 66 is integrated with the electrode supporting section 20 and moved together with this electrode supporting section 20 and the electrode 12 in accordance with the operation of the electrode cylinder 17 and forms a flow channel 67 for the treatment liquid in cooperation with the outer surface of the electrode supporting section 20.

A flow channel for the treatment liquid is also formed in the electrode 12 (the flow channel is referred to as an in-electrode flow channel 12A).

Referring to FIG. 2, the seal jig 13 is disposed on the upper end of the electrode 12, and the air joint 15 is disposed on the workpiece holding jig 14. After the electrode 12 is inserted into the cylinder 2 of the cylinder block 1, the air joint cylinder 29 moves forward to make the air joint 15 abut against the seal jig 13 as shown in FIG. 3, and then, air serving as a working fluid is supplied to a seal member 33 of the seal jig 13 through a main air coupling 22 of the air joint 15 as described in detail later. As a result, the seal member 33 expands only in the radial direction so as to come into contact with the cylinder inner wall surface 3 of the cylinder block 1, thereby sealing the end of the cylinder inner wall surface 3 closer to the crankcase surface 5, which is the one end of the cylinder inner wall surface 3.

Figure 3:
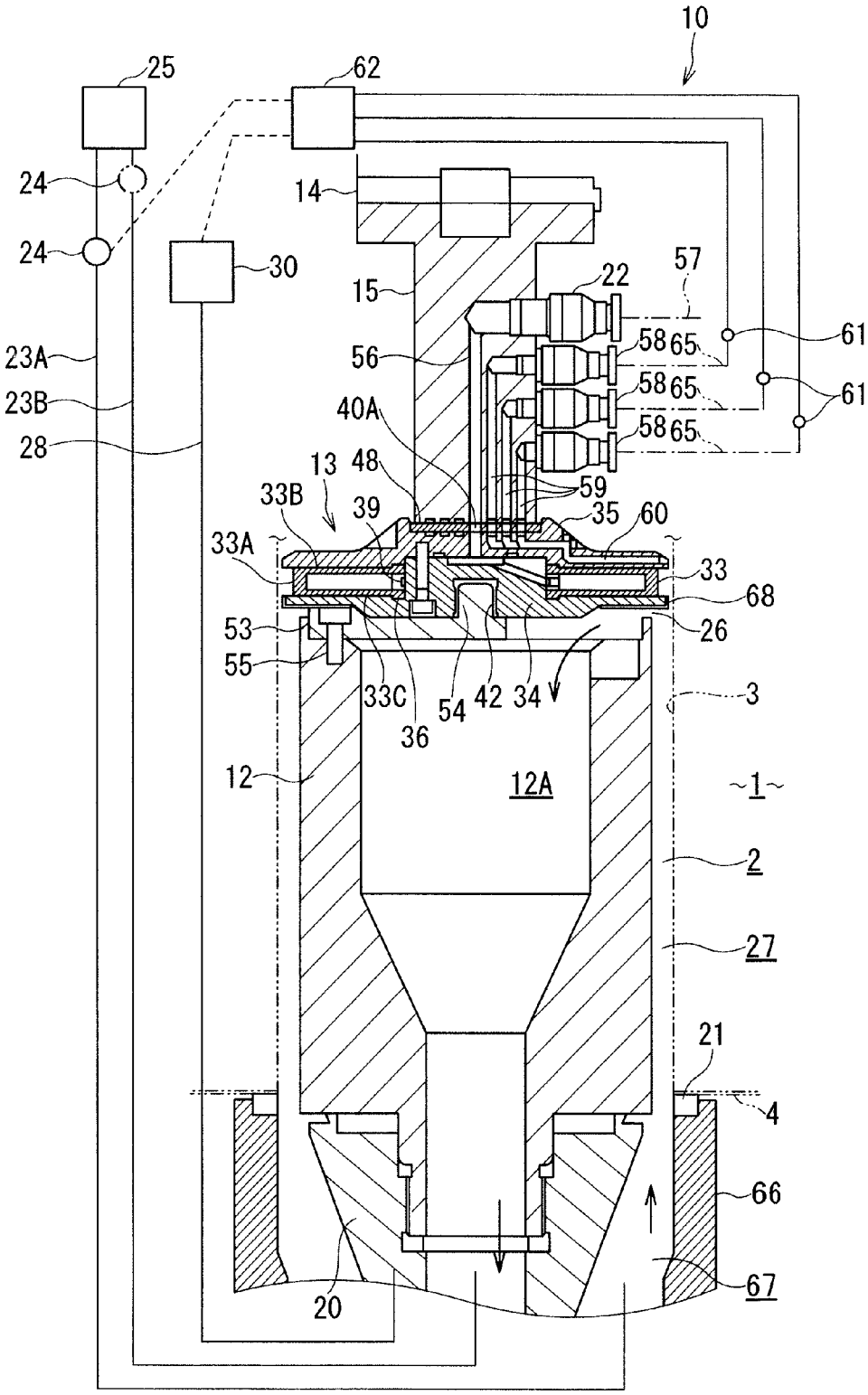
FIG. 3 is a cross-sectional view of an electrode, an air joint and their surroundings in the treatment apparatus shown in FIG. 2.

A treatment liquid pipe 23A is connected to the flow channel block 66 shown in FIGS. 2 and 3. In the case where the treatment apparatus 10 serves as the plating pretreatment apparatus (an electrolytic etching apparatus 72 or an anodic oxidizing apparatus 73), the treatment liquid pipe 23A is provided with a liquid feed pump 24. In a state where the end of the cylinder inner wall surface 3 of the cylinder block 1 closer to the crankcase surface 5 is sealed with the seal jig 13, the liquid feed pump 24 feeds the treatment liquid (plating pretreatment liquid) stored in the chemical tank 25 to a gap flow channel 27 defined by the electrode 12 and the cylinder inner wall surface 3 through the treatment liquid pipe 23A and a flow channel 67 defined by the electrode supporting section 20 and the flow channel block 66 and makes the treatment liquid flow upward through the gap flow channel 27. The treatment liquid having flowed through the gap flow channel 27 then flows through a slit 26 formed between the seal jig 13 and the electrode 12 to reach the in-electrode flow channel 12A, flows downward through the in-electrode flow channel 12A, and then returns to the chemical tank 25 through a treatment liquid pipe 23B described later.

The treatment liquid pipe 23B is connected to the electrode supporting section 20. In the case where the treatment apparatus 10 serves as the plating apparatus, the treatment liquid pipe 23B is provided with a liquid feed pump 24 (indicated by two-dot and chain line). In a state where the end of the cylinder inner wall surface 3 of the cylinder block 1 closer to the crankcase surface 5 is sealed with the seal member 33, the liquid feed pump 24 feeds the treatment liquid (plating solution) stored in the chemical tank 25 to the in-electrode flow channel 12A of the electrode 12 through the treatment liquid pipe 23B and the electrode supporting section 20. The treatment liquid fed to the in-electrode flow channel 12A flows upward through the in-electrode flow channel 12A, through the slit 26 formed between a seal bottom plate 34 (described later) of the seal jig 13 and the electrode 12, downward through the gap flow channel 27 defined by the outer surface of the electrode 12 and the cylinder inner wall surface 3 of the cylinder block 1, and through the flow channel 67 defined by the electrode supporting section 20 and the flow channel block 66, and then returns to the chemical tank 25 through the treatment liquid pipe 23A.

As shown in FIGS. 2 and 3, a lead (lead wire) 28 is connected to the electrode supporting section 20 and to the power supply device 30. The conducting plate 95 that is disposed on the workpiece holding jig 14 and abuts against the cylinder block 1 is also connected to the power supply device 30 by a lead (lead wire) 96. The power supply device 30 supplies electricity to the electrode 12 through the lead 28 and the electrode supporting section 20 and to the cylinder block 1 through the lead 96 and the conducting plate 95 when the gap flow channel 27 is filled with the treatment liquid, and the treatment liquid is flowing.

In the plating pretreatment of the cylinder inner wall surface 3 of the cylinder block 1, the electrode 12 serves as a negative electrode, and the cylinder block 1 serves as a positive electrode. In the plating treatment of the cylinder inner wall surface 3, the electrode 12 serves as a positive electrode, and the cylinder block 1 serves as a negative electrode, thereby forming a plating film on the cylinder inner wall surface 3. A single type of a treatment apparatus can perform both the plating pretreatment and the plating treatment by using different treatment liquids and energization conditions, for example.

Reference numeral 31 in FIG. 2 denotes a cleaning shutter used in cleaning the head surface 4 of the cylinder block 1 by ejecting a cleaning liquid. The cleaning shutter moves forward after the plating pretreatment or plating treatment of the cylinder inner wall surface 3 of the cylinder block 1 has been completed and the electrode 12 has been retracted from the cylinder block 1.

Next, a configuration of the seal jig 13, the air joint 15 and other components will be described with reference to FIGS. 3 and 4.

The seal jig 13 comes into contact with the cylinder inner wall surface 3 to seal the cylinder inner wall surface 3 when the treatment liquid is introduced to the gap flow channel 27 including the cylinder inner wall surface 3 of the cylinder block 1. The seal jig 13 includes the seal member 33, the seal bottom plate 34 and a seal base 35.

As shown in FIG. 4, the seal member 33 is made of a stretchable material such as a rubber or other elastic material, for example, and has the shape of a ring buoy. The seal member 33 has a cavity 49 formed in the inner surface thereof and engaging protrusions 36 formed on the opposite surfaces thereof in the vicinity of the opening of the cavity 49. An outer surface 33A of the seal member 33 comes into contact with the cylinder inner wall surface 3 of the cylinder block 1.

As shown in FIG. 4, the seal bottom plate 34 includes a disk-like portion 32 and a raised portion 37 formed integrally with the disk-like portion 32 at the middle of the disk-like portion 32. A ring member 39 having a circumferential groove 38 is disposed around the raised portion 37. In the raised portion 37, main air flow channels 40C and 40D communicating with each other are formed. A plurality of, for example, three, main air flow channels 40D are formed at equal intervals in the radial direction of the seal bottom plate 34. The main air flow channels 40D communicate with the circumferential groove 38 of the ring member 39 and with a plurality of, for example, three, main air flow channels 40E that are formed in the ring member 39 at different circumferential positions and communicate with the circumferential groove 38.

In the disk-like portion 32 of the seal bottom plate 34, a ring-shaped engaging groove 41 is formed along the boundary with the raised portion 37. The engaging protrusion 36 of the seal member 33 is engaged with the engaging groove 41. The disk-like portion 32 and the raised portion 37 have a female threaded portion 42 for fastening and a threaded bolt hole 44 for insertion of a bolt 43. With the ring member 39 being fitted into the cavity 49 of the seal member 33, and the engaging protrusion 36 of the seal member 33 being engaged with the engaging groove 41, the disk-like portion 32 of the seal bottom plate 34 configured as described above supports the seal member 33 from one side (the side of a lower surface 33*c* in FIG. 4) of the seal member 33.

As shown in FIG. 4, the seal base 35 includes a disk-like portion 45 and a raised portion 46 formed integrally with the disk-like portion 45 at the middle of the disk-like portion 45. A counterbore 47 and a main air flow channel 40B are formed in the raised portion 46. A seal sheet 48 is mounted on the counterbore 47, and a main air flow channel 40A communicating with the main air flow channel 40B is formed in the seal sheet 48. The main air flow channel 40B communicates with the main air flow channel 40C in the seal bottom plate 34.

The disk-like portion 45 has a recess 50, into which the raised portion 37 of the seal bottom plate 34 can be fitted, on the side opposite to the counterbore 47. The disk-like portion 45 further has a ring-shaped engaging groove 51 formed along the outer perimeter of the recess 50. The engaging protrusion 36 of the seal member 33 is engaged with the engaging groove 51. The disk-like portion 45 and the raised portion 46 have a threaded bolt hole 52 for threaded insertion of the bolt 43.

In conditions in which the raised portion 37 of the seal bottom plate 34 is fitted into the recess 50 of the seal base 35, the ring member 39 of the seal bottom plate 34 is fitted into the cavity 49 of the seal member 33, and the engaging protrusions 36 of the seal member 33 is engaged with the engaging groove 41 of the seal bottom plate 34 and the engaging groove 51 of the seal base 35, the bolt 43 is threaded into the threaded bolt hole 44 of the seal bottom plate 34 and the threaded bolt hole 52 of the seal base 35, thereby integrating the seal member 33, the seal bottom plate 34 and the seal base 35 with each other to thereby form the seal jig 13.

In this state, the seal bottom plate 34 and the seal base 35 are positioned so as to face each other, the disk-like portion 32 of the seal bottom plate 34 supports the seal member 33 from one side thereof (the side of the lower surface 33*c* in FIG. 4), and the disk-like portion 45 of the seal base 35 supports the seal member 33 from the other side thereof (the side of an upper surface 33B in FIG. 4). When the seal member 33, the seal bottom plate 34 and the seal base 35 are integrated with each other, the main air flow channels 40A, 40B, 40C, 40D and 40E communicating with each other communicate with the interior of the seal member 33.

As shown in FIG. 3, the seal jig 13 is attached to the upper end of the electrode 12 with a seal jig attachment plate 53 serving as an insulating member interposed therebetween. The seal jig attachment plate 53 has four notches and thus is substantially cross-shaped. The seal jig attachment plate 53 further has a male threaded portion 54 for fastening at the middle thereof. The substantially cross-shaped seal jig attachment plate 53 has arms fixed to the electrode 12 with bolts 55. By threading the male threaded portion 54 of the seal jig attachment plate 53 into the female threaded portion 42 of the seal bottom plate 34 of the seal jig 13, the seal jig 13 composed of the seal member 33, the seal bottom plate 34 and the seal base 35 is attached to the seal jig attachment plate 53.

The seal jig attachment plate 53 is made of a resin or other nonconductive material and insulates the seal bottom plate 34 and the seal base 35 made of a conductive metal from the electrode 12. In addition, as shown by the arrow in FIG. 3, for example, the treatment liquid having passed through the slit 26 flows into the in-electrode flow channel 12A through the notches of the substantially cross-shaped seal jig attachment plate 53. In order to improve the insulating properties, an insulating collar 68 is attached to the lower surface of the seal jig attachment plate 53 along the outer perimeter thereof.

The air joint 15 shown in FIGS. 2 and 3 has the main air coupling 22 as described above and has a main air supply channel 56 formed therein. The main air coupling 22 is connected to an air supply valve and a compressor, both not shown, via main air supply piping 57. After the electrode 12 is inserted into the cylinder 2 of the cylinder block 1, when the air joint cylinder 29 moves forward, the air joint 15 moves toward the seal jig 13 attached to the electrode 12, abuts against the seal sheet 48 of the seal jig 13 and is thereby coupled to the seal jig 13. In this coupled state, the main air supply channel 56 of the air joint 15 communicates with the main air flow channel 40A of the seal sheet 48 of the seal jig 13. The seal sheet 48 prevents leakage of air supplied from the main air supply channel 56 to the main air flow channel 40A.

Figure 4A:
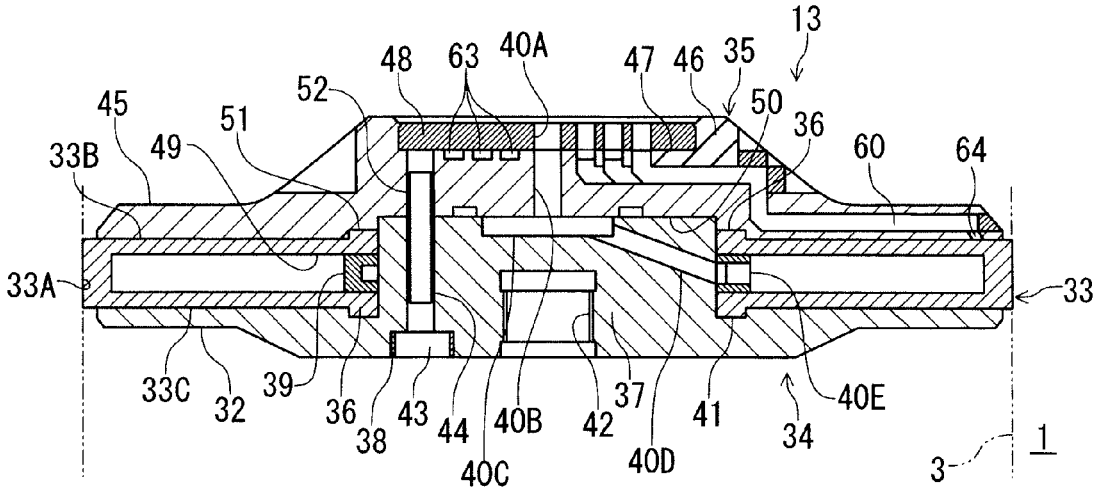
FIG. 4A shows a state where a seal member is expanded.

As shown in FIG. 4, the air supplied from the main air supply channel 56 to the main air flow channel 40A is guided into the seal member 33 through the main air flow channels 40B, 40C, 40D and 40E. The seal member 33 is supported by the seal base 35 on the side of the upper surface 33*b* and by the seal bottom plate 34 on the side of the lower surface 33C and is prevented thereby from expanding upward and downward. Thus, as shown in FIG. 4A, the seal member 33 expands only in the radial direction, and the outer surface 33A of the seal member 33 comes into contact with the cylinder inner wall surface 3 of the cylinder block 1, thereby sealing the end of the cylinder inner wall surface 3 closer to the crank case surface 5. As a result, the plating pretreatment liquid or the plating liquid is prevented from leaking from the gap flow channel 27 (FIG. 3) defined by the cylinder inner wall surface 3 and the outer surface of the electrode 12 into the space on the side of the crankcase surface 5.

Figure 4B:
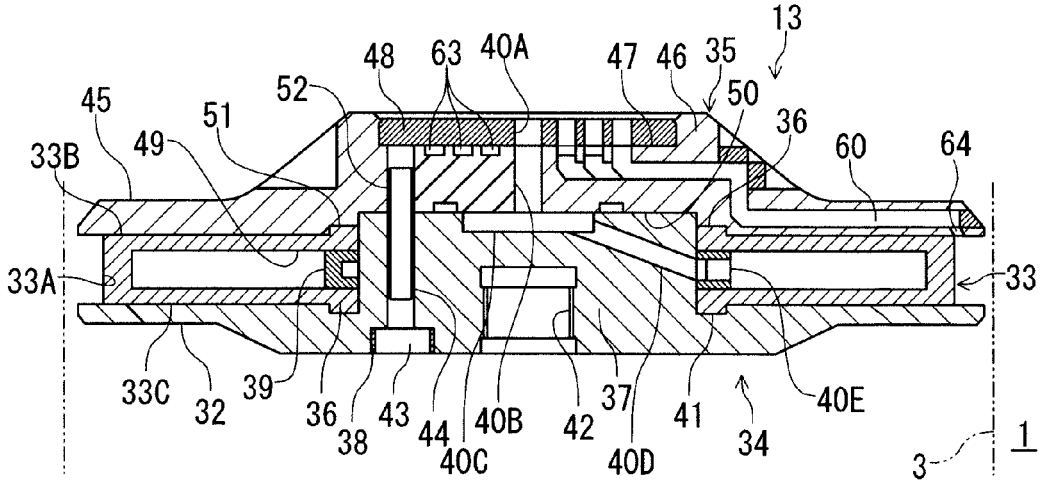
FIG. 4B shows a state where the seal member is shrunk.

When air supply into the seal member 33 through the main air coupling 22 is stopped, as shown in FIG. 4B, the seal member 33 shrinks in the radial direction, and the outer surface 33A is separated from the cylinder inner wall surface 3. Thereafter, when the air joint cylinder 29 moves backward, the air joint 15 is separated from the seal jig 13.

As shown in FIG. 3, checking means that checks the expansion and shrinkage of the seal member 33 is provided on the seal jig 13 and the air joint 15. The checking means comprises a sub air coupling 58 and a sub air supply channel 59 provided on the side of the air joint 15, a sub air flow channel 60 provided on the side of the seal jig 13, an air pressure sensor 61, and a controller 62.

A plurality of, for example, three, sub air couplings 58 are attached to the air joint 15. A plurality of, for example, three, sub air supply channels 59 associated and communicating with the sub air couplings 58 are formed in the air joint 15.

As shown in FIG. 4, the sub air flow channel 60 is formed in the seal base 35 of the seal jig 13. The seal base 35 has a plurality of (for example, three) concentric ring grooves 63, or more specifically, the same number of concentric ring grooves 63 as the number of the sub air supply channels 59 formed in the top surface of the raised part 46, and each of the ring grooves 63 communicates with a corresponding one of the sub air supply channels 59 (FIG. 3).

Furthermore, the seal base 35 has a plurality of (for example, three) sub air flow channels 60, or more specifically, the same number of sub air flow channels 60 as the number of the ring grooves 63 formed radially at regular intervals. Each of the sub air flow channels 60 communicates with a corresponding one of the ring grooves 63. Each sub air flow channel 60 has an air outlet 64 at the outer perimeter of the seal base 35.

As shown in FIG. 4, the air outlet 64 is formed at a position where the air outlet 64 is closed by the seal member 33 when the seal member 33 expands, and is opened when the seal member 33 shrinks.

The air serving as a working fluid introduced through the sub air couplings 58 on the air joint 15 shown in FIG. 2 flows through the sub air supply channels 59 and through the ring grooves 63 and the sub air flow channels 60 of the seal jig 13 (FIG. 4) and is discharged through the air outlets 64. When the seal member 33 is shrunk, the air is discharged through the air outlets 64 and the air outlets 64 are opened, rather than closed by the seal member 33, as shown in FIG. 4B. When the air is discharged, the air pressure in the sub air flow channels 60, the sub air supply channels 59 and the sub air couplings 58 decreases.

To the contrary, when the seal member 33 is expanded, the air outlets 64 are closed by the seal member 33 as shown in FIG. 4A, and the air is not discharged through the air outlets 64. Thus, the air pressure in the sub air flow channels 60, the sub air supply channels 59 and the sub air couplings 58 increases.

For example, as shown in FIG. 3, a plurality of, for example, three, pieces of sub air supply piping 65 for introducing the air to the plurality of sub air couplings 58 are each provided with the air pressure sensor 61, and the air pressure sensors 61 detect the air pressure in the sub air flow channels 60, respectively, described above. Based on the value of the detected air pressure, it may be checked whether the seal member 33 of the seal jig 13 is expanded or shrunk. That is, it can be checked whether the seal member 33 is expanded and in contact with the cylinder inner wall surface 3 of the cylinder block 1 and liquid-tightly seals the cylinder inner wall surface 3, or the seal member 33 is shrunk and separated from the cylinder inner wall surface 3 of the cylinder block 1 and does not seal the cylinder inner wall surface 3.

Sealing of the cylinder inner wall surface 3 of the cylinder block 1 by expansion of the seal member 33 is checked along the entire periphery of the seal member 33, since a plurality of sub air flow channels 60 are formed and located at regular intervals along the periphery of the seal base 35 (that is, along the periphery of the seal member 33), for example, three sub air flow channels 60 are formed at 120 degrees along the periphery of the seal member 33. Therefore, when the periphery of the seal member 33 is partially deteriorated, cracks or is damaged. Therefore, insufficiently expands and fails to come into contact with the cylinder inner wall surface 3 of the cylinder block 1 although the remaining part of the seal member 33 normally expands, sealing of the cylinder inner wall surface 3 can be checked by checking the expansion of the periphery of the seal member 33.

The controller 62 shown in FIG. 3 receives the detection value from the air pressure sensor 61 and controls driving of the liquid feed pump 24 and the power supply device 30. Specifically, if the detection value from the air pressure sensor 61 is higher than a predetermined value, the controller 62 determines that the seal member 33 of the seal jig 13 expands and comes into contact with the cylinder inner wall surface 3 of the cylinder block 1, and the end of the cylinder inner wall surface 3 closer to the crank case surface 5 is adequately sealed. Then, the controller 62 activates the liquid feed pump 24 to supply the treatment liquid to the gap flow channel 27 defined by the cylinder inner wall surface 3 and the outer surface of the electrode 12 and then drives the power supply device 30 to thereby supply power to the electrode 12 and the cylinder block 1 to perform the plating pretreatment (electrolytic etching treatment, anodic oxidation treatment) or the plating treatment of the cylinder inner wall surface 3.

If the detection value from the air pressure sensor 61 is equal to or lower than the predetermined value, the controller 62 determines that the seal member 33 of the seal jig 13 does not adequately expand or shrinks and fails to come into contact with the cylinder inner wall surface 3, and therefore, the cylinder inner wall surface 3 is inadequately sealed. In this case, the controller 62 does not drive the liquid feed pump 24 and the power supply device 30 or stops any of them in operation.

As described above, in particular, when the treatment apparatus 10 serves as the plating pretreatment apparatus (an electrolytic etching apparatus 72 or an anodic oxidizing apparatus 73), at least one of the power supply device 30 that supplies electricity to the electrode 12 and the cylinder block 1 (power supply device 92, 93 in FIG. 1) and the liquid feed pump 24 that feeds the treatment liquid to the gap flow channel 27 between the cylinder inner wall surface 3 and the electrode 12 (liquid feed pump 84, 87 in FIG. 1) (both the power supply device 30 and the liquid feed pump 24 in this embodiment) is provided for each of the plurality of cylinders 2 of the cylinder block 1.

Figure 5:
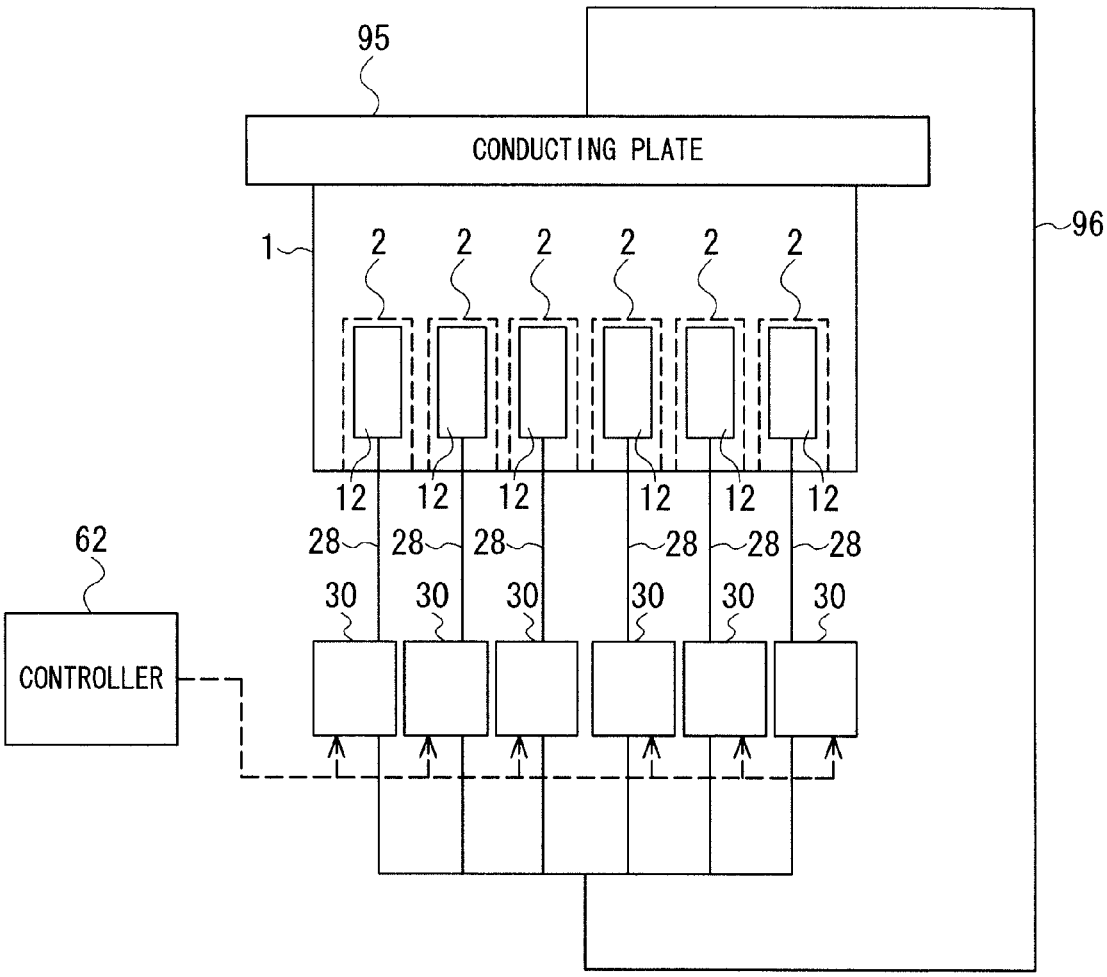
FIG. 5 is an electrical circuit diagram showing a path for supplying electricity to a cylinder block and electrodes shown in FIG. 2.

That is, as shown in FIG. 5, one electrode 12 is inserted into each of the plurality of (six, for example) cylinders of the cylinder block 1, and one power supply device 30 is provided for each of the cylinders 2 of the cylinder block 1 to supply electricity to the cylinder block 1 and the associated one of the plurality of (six, for example) electrodes 12. Each of the plurality of (six, for example) power supply devices 30 is connected to the associated one of the plurality of electrodes 12 by means of the lead 28, and all the power supply devices 30 are connected to the single conducting plate 95 on the workpiece holding jig 14 (FIG. 2) by means of the lead 96. Each power supply device 30 supplies electricity to the associated electrode 12 and the cylinder block 1, measures the value of the supplied current or voltage (current, for example) and feeds the measurement value back to the controller 62, and the controller 62 adjusts the current or voltage (current, for example) to be supplied to a predetermined value based on the measurement value during the plating pretreatment in real time.

In a default setting, the controller 62 controls the power supply devices 30 to make the power supply devices 30 supply an equal current or voltage to the cylinder block and their respective associated electrodes 12 in the cylinders 2 of the cylinder block 1. Then, if there is a cylinder 2 for which the plating pretreatment of the cylinder inner wall surface 3 cannot be achieved with the same uniformity as that of the other cylinders 2 even by using the number-of-revolution control of the liquid feed pump 24 described later, the controller 62 controls the power supply device 30 associated with the electrode 12 in the cylinder 2 to make the power supply device 30 supply a different current or voltage to the electrode 12 in the cylinder 2.

An equal current or voltage is supplied to the electrodes 12 in all the cylinders 2 of the cylinder block 1 and the cylinder block 1 itself in the default setting in order to achieve the plating pretreatment (electrolytic etching treatment, for example) of a cylinder having a different electrical resistance with the same uniformity as the other cylinders 2.

Figure 7:
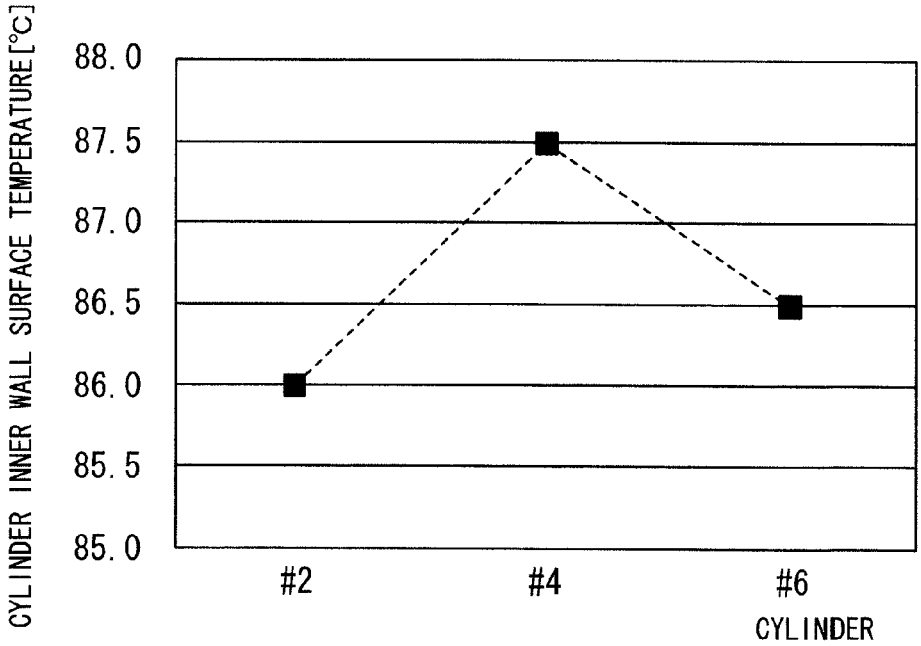
FIG. 7 is a graph showing a relationship between respective cylinders of the cylinder block in FIG. 6 and temperatures of inner wall surfaces of these cylinders.
Figure 8:
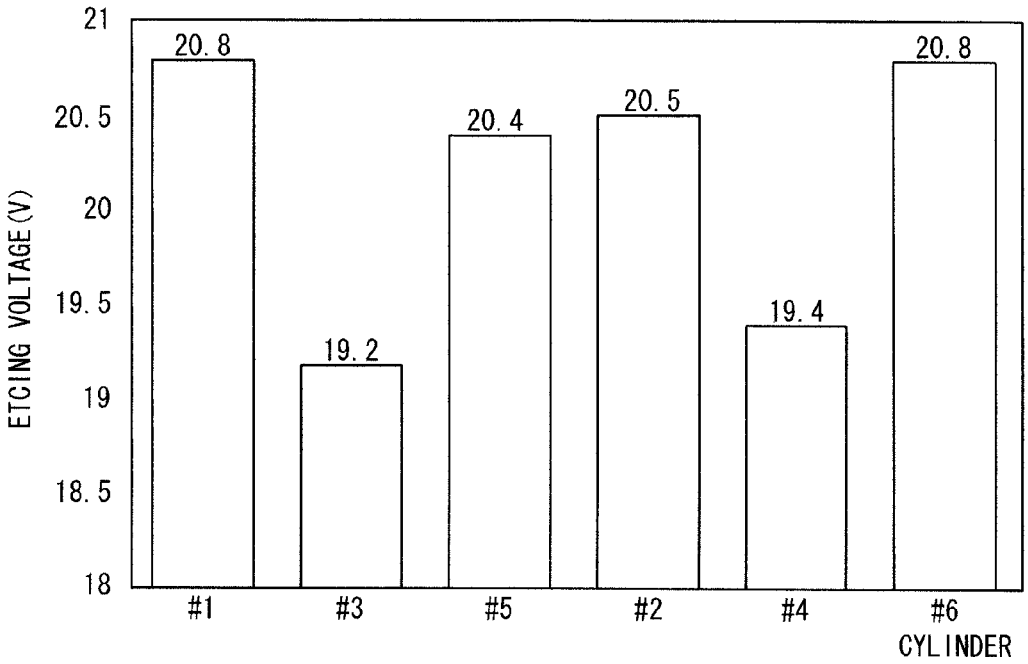
FIG. 8 is a graph showing a relationship between etching voltage and the respective cylinders in an electrolytic etching treatment with respect to the cylinder block shown in FIG. 6.

More specifically, for example, for the V-type six-cylinder cylinder block, cylinders 2 located at middle positions (cylinders #3 and #4) are interposed between the cylinders located at end positions (cylinders #1, #2, #5 and #6) as shown in FIG. 6. Therefore, heat is more efficiently retained on the cylinders 2 at the middle positions than on the cylinders 2 at the end positions, so that the temperature of the cylinder inner wall surfaces 3 of the cylinders 2 at the middle positions tends to be higher than that of the cylinder inner wall surfaces 3 of the cylinders at the end positions as shown in FIG. 7. As a result, the activity of the cylinder inner wall surfaces 3 of the cylinders 2 at the middle positions (cylinders #3 and #4) is made higher than that of the other cylinders 2, the electrical resistance of the cylinder inner wall surfaces 3 of the cylinders 2 at the middle positions (cylinders #3 and #4) is made lower than that of the other cylinders 2, and thus, electric current can more easily flow through the cylinders at the middle positions (cylinders #3 and #4) than through the other cylinders 2. This is also apparent from FIG. 8, which shows that, in a conventional constant current control in which a constant current is supplied from a single power supply device to the electrodes 12 in all the cylinders of the cylinder block 1, the voltage (etching voltage, for example) tends to be lower for the cylinders 2 at the middle positions (cylinders #3 and #4) than for the other cylinders 2. As can be seen from the above description, in the conventional constant current control in which a single power supply supplies an electric current to the V-type 6-cylinder cylinder block, and the electric current is distributed among the electrodes 12 in the cylinders 2 by natural consequences, the electric current intensively flows to the cylinders 2 at the middle positions through which the electric current can more easily flow, and therefore, the plating pretreatment cannot be performed on the cylinder inner wall surfaces 3 of all the cylinders 2 under the same conditions.

Figure 9:
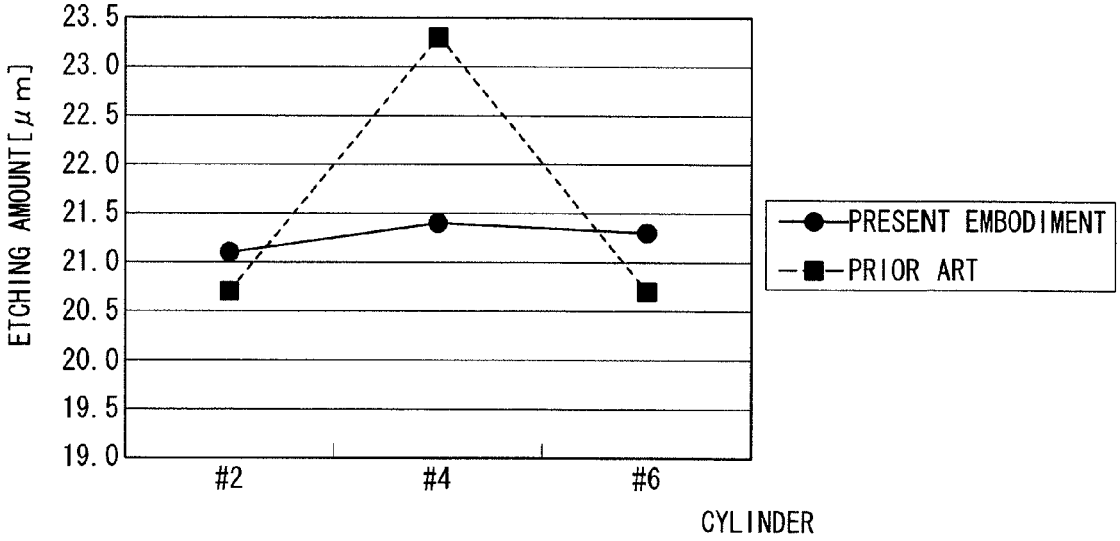
FIG. 9 is a graph showing a relationship between etching amount and the respective cylinders in the electrolytic etching treatment with respect to the cylinder block shown in FIG. 6.

For example, if the treatment conditions are set to ensure that the cylinder inner wall surfaces 3 of the cylinders 2 at the end positions (cylinders #1, #2, #5 and #6) that are less susceptible to electrolytic etching are adequately etched, the cylinder inner wall surfaces 3 of the cylinders 2 at the middle positions (cylinders #3 and #4) that are more susceptible to electrolytic etching are over-etched (shown by the dotted line in FIG. 9). If the treatment conditions are set to ensure that the cylinder inner wall surfaces 3 of the cylinders 2 at the middle positions are adequately etched, the cylinder inner wall surfaces 3 of the cylinders at the end positions that are less susceptible to etching is inadequately etched, and thus, the adhesion of the plating film tends to be lowered.

To solve such defect or problem, in the default setting, the power supply devices 30 associated with the cylinders 2 control the current or voltage supplied to the cylinder block 1 and the electrodes 12 in their respective associated cylinders 2 in real time to make the current or voltage uniform among the cylinders 2. As a result, for example, the electrolytic etching is uniformly performed on the cylinders 2 having different electrical conductivities of the cylinder block 1 as shown by the solid line in FIG. 9.

Since a uniform current or voltage is supplied to the cylinder block 1 and the electrodes 12 in the plurality of cylinders 2 as described above, in the plating pretreatment of the cylinder block 1, the outlet temperature of the treatment liquid flowing out of each of the plurality of cylinders 2 is related with the degree of the reaction of the plating pretreatment performed on the cylinder inner wall surface 3 of the cylinder 2. For example, the higher the degree of the reaction of the plating pretreatment of the cylinder inner wall surface 3 of the cylinder 2, the higher the outlet temperature of the treatment liquid flowing out of the cylinder 2 is, and the lower the degree of the reaction of the plating pretreatment of the cylinder inner wall surface 3 of the cylinder 2, the lower the outlet temperature of the treatment liquid flowing out of the cylinder 2 is.

Figure 10:
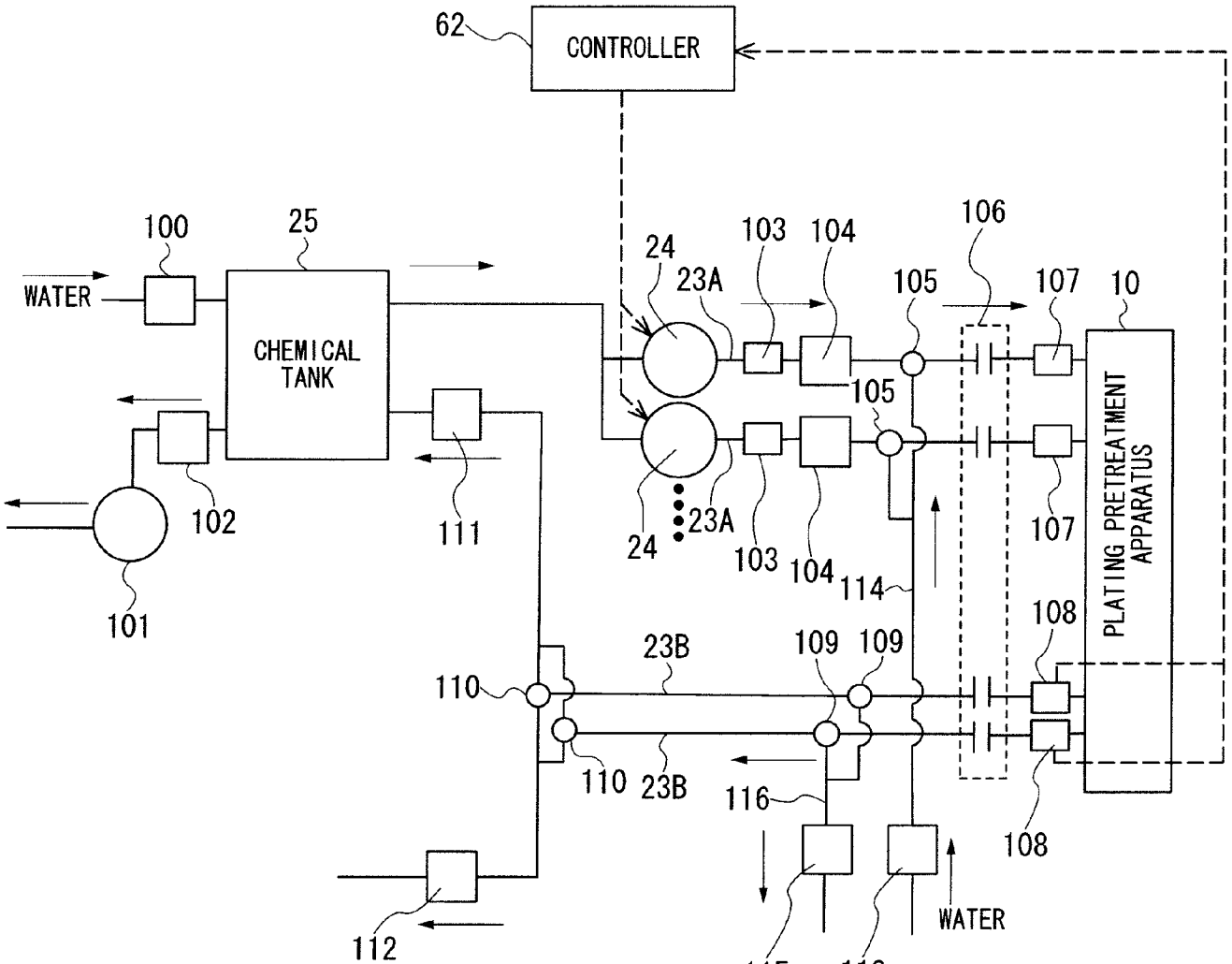
FIG. 10 is a diagram showing a configuration of a flow path of a treatment liquid supplied from a chemical tank to the plating pretreatment apparatus shown in FIG. 1.

The liquid feed pumps 24 (84, 87) shown in FIGS. 1 and 10 are to feed the treatment liquid to the gap flow channels 27 (FIG. 3) defined by the electrodes 12 and the cylinder inner wall surfaces 3 of the cylinders 2 of the cylinder block 1 mounted in the plating pretreatment apparatus, such as the electrolytic etching apparatus 72 and the anodic oxidizing apparatus 73. As described above, one liquid feed pump is provided for each cylinder 2 of the cylinder block 1.

In the case where the treatment apparatus 10 serves as the plating pretreatment apparatus, the liquid feed pump 24 is provided on the treatment liquid pipe 23A shown in FIGS. 2 and 3 that serves as an inflow path for introducing the treatment liquid from the chemical tank 25 to the cylinder 2 of the cylinder block 1. Treatment liquid pipes 23A of the number (six, for example) same as the number (six, for example) of the cylinders 2 are provided to separately introduce the treatment liquid to the cylinders 2 of the cylinder block 1.

As shown in FIG. 10, one liquid feed pump 24 is provided on each treatment liquid pipe 23A. The treatment liquid pipes 23B shown in FIGS. 2, 3 and 10 serve as outflow paths for discharging the treatment liquid from the plurality of (six, for example) cylinders 2 of the cylinder block 1. Treatment pipes 23B of the number (six, for example) same as the number of the cylinders 2 are provided.

Next, a treatment liquid path for circulating the treatment liquid from the chemical tank 25 to the plating pretreatment apparatus will be further described with reference to FIG. 10.

Although the treatment liquid reservoir (treatment liquid reservoir 85, 88 in FIG. 1) includes two chemical tanks 25 (chemical tanks 83, 86 in FIG. 1), FIG. 10 shows only one representative chemical tank.

A water supply valve 100 is provided at a water supply port of the chemical tank 25, and a discharge pump 101 and a discharge valve 102 are provided at a discharge port. When the level of the liquid in the chemical tank 25 is lowered, the water supply valve 100 is opened to supply water into the chemical tank 25. When the treatment liquid is to be discharged from the chemical tank 25, the discharge valve 102 is opened, and the discharge pump 101 is driven.

Each treatment liquid pipe 23A serving as the inflow path includes the liquid feed pump 24, a flowmeter 103, a washing switch valve 104, a three-way valve 105 and a connection switch valve 106 arranged in this order in the direction from the upstream side to the downstream side. Each treatment liquid pipe 23A further includes an inlet thermometer 107 located immediately before the plating pretreatment apparatus. In the default setting time, the flow rate of the treatment liquid is measured by the flowmeter 103 so as to adjust the number of revolutions of the liquid feed pump 24. In addition, the temperature of the treatment liquid in the chemical tank 25 is adjusted based on the temperature of the treatment liquid measured by the inlet thermometer 107.

Each treatment liquid pipe 23B serving as the outflow path is incorporated with an outlet thermometer 108, a connection switch valve 106, and three-way valves 109 and 110 arranged in this order in the direction from the upstream side to the downstream side. The outflow path is further provided with a discharge switch valve 111 between the three-way valve 110 and the chemical tank 25 and a washing water drain valve 112 between the three-way valve 110 and a drain tank, not shown.

When the discharge switch valve 111 is opened, and the washing water drain valve 112 is closed, the treatment liquid in the treatment liquid pipe 23B is returned to the chemical tank 25. The outlet thermometer 108 measures the temperature of the treatment liquid immediately after the treatment liquid is discharged from the cylinder 2 of the cylinder block 1.

The connection switch valves 106 provided on the treatment liquid pipes 23A and 23B are closed to prevent the treatment liquid from being fed to or flowing back to any unused treatment liquid pipes 23A and 23B in the case where the number of cylinders 2 of the cylinder block 1 to be treated is less than 6.

To supply the washing water to each cylinder 2 of the cylinder block 1 instead of the treatment liquid, a washing water supply pipe 114 provided with a washing water supply valve 113 is connected to the three-way valve 105. To discharge the washing water from each cylinder 2 of the cylinder block 1, a washing water discharge pipe 116 provided with a washing water discharge valve 115 is connected to the three-way valve 109. By closing the washing switch valve 104 and opening the washing water supply valve 113 and the washing water discharge valve 115, the washing water is supplied from a washing water tank, not shown, to the cylinders 2 of the cylinder block 1 installed in the plating pretreatment apparatus to wash the cylinder inner wall surfaces 3 of the cylinders 2 and then is returned to the washing water tank.

If the washing water is to be discharged rather than being returned to the washing water tank, the washing water is discharged through the washing water drain valve 112 provided for the treatment liquid pipe 23B by opening the washing water drain valve 112 and closing the discharge switch valve 111.

The liquid feed pumps 24 provided on the treatment liquid pipes 23A in a one-to-one relationship are controlled by the controller 62. The outlet temperature of the treatment liquid flowing out of the plurality of cylinders 2 of the cylinder block 1 installed in the plating pretreatment apparatus is measured by the outlet thermometer 108.

During the plating pretreatment, the controller 62 adjusts the number of revolutions of the liquid feed pump 24 associated with each cylinder 2 of the cylinder block 1 based on the measurement value from the outlet thermometer 108 so as to control the flow rate of the treatment liquid fed to the associated cylinder 2 by the liquid feed pump 24 in real time.

That is, the plating pretreatment, such as the electrolytic etching treatment, is an exothermic reaction, and therefore, the temperature of the treatment liquid in the cylinders 2 increases. For the V-type six-cylinder cylinder block 1 (FIG. 6), the cylinders 2 located at the middle positions (cylinders #3 and #4) are interposed between the cylinders located at the end positions (cylinders #1, #2, #5 and #6). Therefore, heat is more efficiently retained on the cylinders 2 at the middle positions than on the cylinders 2 at the end positions, so that the temperature of the cylinders at the middle positions tends to be higher than that of the cylinders at the end positions. However, a significant temperature increase can lead to an excessive plating pretreatment (electrolytic etching, for example), and therefore, the reaction temperature in the cylinders 2 has to be controlled.

Furthermore, in the case where a single liquid feed pump is used to distribute the treatment liquid among the plurality of cylinders 2 of the cylinder block 1 as in the prior art, it is difficult to feed the treatment liquid to the cylinders 2 through piping of exactly the same configuration, and thus, the flow speed of the treatment liquid varies among the cylinders 2. Therefore, even if the inlet temperature of the treatment liquid is controlled to be equal on all the cylinders, the temperature of the treatment liquid can increase higher in the cylinder 2 for which the flow speed is lower, and the amount of plating pretreatment (the amount of electrolytic etching, for example) of the cylinder inner wall surface 3 can be greater for that cylinder 2 than for the other cylinders 2.

To solve this defect or problem, according to this embodiment, one liquid feed pump 24 is provided for each cylinder 2 of the cylinder block 1, and the controller 62 controls the flow speed (i.e., flow rate) of the treatment liquid in each cylinder 2. Thus, the controller 62 can separately control the temperature of the treatment liquid in each cylinder 2. The outlet thermometer 108 measures the outlet temperature of the treatment liquid flowing out of each cylinder 2 and feeds the measurement value back to the controller 62. If the outlet temperature of the treatment liquid is higher than an upper control limit, the controller 62 increases the pump frequency in real time to increase the amount of liquid fed by the liquid feed pump 24, thereby decreasing the temperature of the treatment liquid in the cylinder 2 to reduce the amount of plating pretreatment (the amount of electrolytic etching, for example). If the outlet temperature of the treatment liquid is lower than a lower control limit, the controller 62 decreases the pump frequency to decrease the flow speed of the treatment liquid to reduce the flow rate of the treatment liquid, thereby increasing the temperature of the treatment liquid in the cylinder 2 to prevent reduction of the amount of plating pretreatment (the amount of electrolytic etching, for example) of the cylinder inner wall surface 3. The term "pump frequency" refers to the frequency of an alternating current supplied from a pump driving inverter (not shown) to the liquid feed pump 24.

Figure 11:
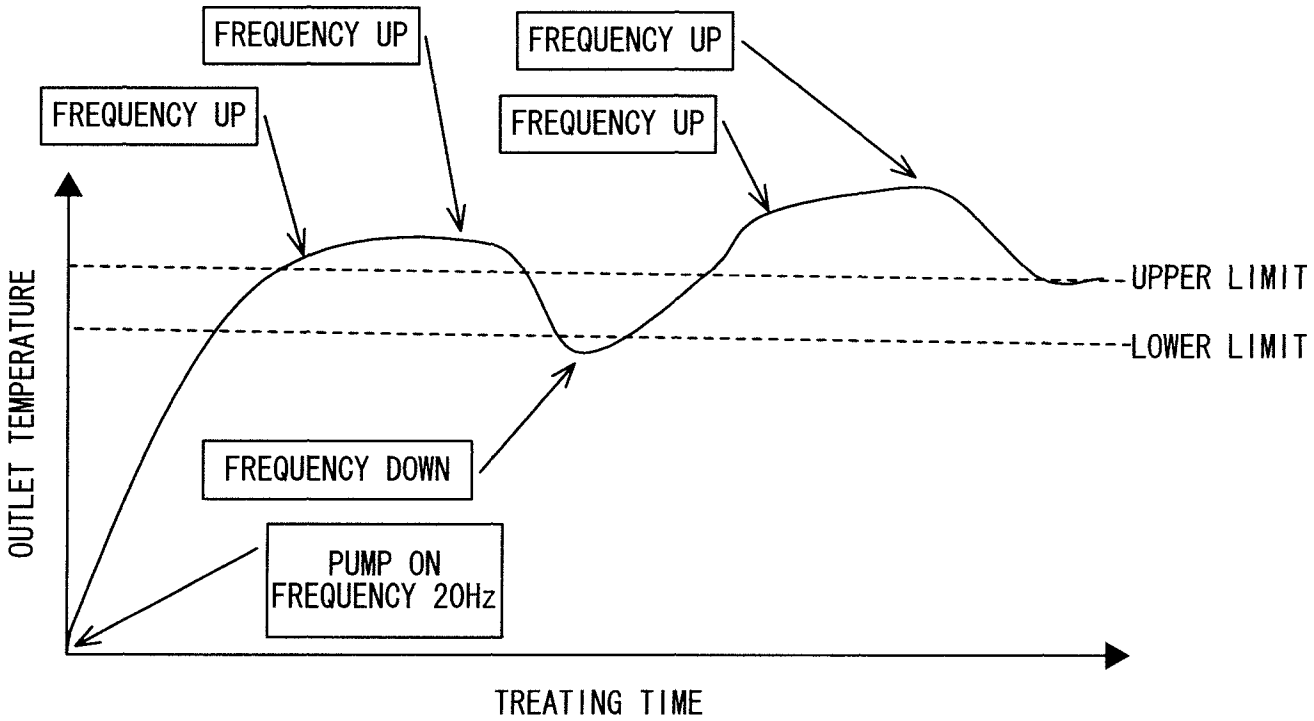
FIG. 11 is a graph showing an example of control manner of the number of revolutions of a liquid feed pump shown in FIG. 10.

More specifically, the outlet thermometer 108 monitors the outlet temperature of the treatment liquid flowing out of the cylinder 2 every 10 seconds, and if the measurement value of the outlet temperature of the treatment liquid is higher than the upper control limit, the controller 62 increases the pump frequency from 20 Hz to 21 Hz, for example, as shown in FIG. 11. After 10 seconds, the outlet thermometer 108 monitors the outlet temperature of the treatment liquid. If the measurement value of the outlet temperature of the treatment liquid is still higher than the upper control limit, the controller 62 increases the pump frequency from 21 Hz to 22 Hz, for example. Then, the outlet thermometer 108 monitors the outlet temperature of the treatment liquid again. If the measurement value is lower than the lower control limit, the controller 62 decreases the pump frequency from 22 Hz to 21 Hz, for example.

The controller 62 continuously performs these operations during the plating pretreatment (electrolytic etching, for example), and therefore, the amount of plating pretreatment (amount of electrolytic etching, for example) can be made uniform for the cylinder inner wall surfaces 3 of the plurality of cylinders 2. The increase of the outlet temperature of the treatment liquid flowing out of the cylinders 2 due to the heat of the reaction of the plating pretreatment (electrolytic etching, for example) varies among the cylinders and therefore has to be separately controlled for each cylinder 2.

In the case where the outlet temperature of the treatment liquid flowing out of a cylinder 2 does not fall within the range between the upper control limit and the lower control limit, for example, if the outlet temperature of the treatment liquid is equal to a predetermined temperature higher than the upper control limit or equal to a predetermined temperature lower than the lower control limit, or in the case where the outlet temperature of the treatment liquid does not fall within the range between the upper control limit and the lower control limit even after the pump frequency is increased (UP) or decreased (DOWN) a predetermined number of times (three times, for example), the controller 62 stops making the current or voltage supplied to the cylinder block 1 and the electrodes 12 in the cylinders 2 uniform among the cylinders 2 and instead controls the power supply device 30 associated with the relevant cylinder 2 to increase or decrease the current or voltage supplied to the cylinder 2, thereby making the plating pretreatment (electrolytic etching, for example) uniform among the cylinders 2.

The above control method has been described with respect to the electrolytic etching treatment, for example. However, the same control method may be conducted in the anodic oxidation treatment. In that case, however, the upper control limit and the lower control limit for the outlet temperature of the treatment liquid flowing out of the cylinders 2, the pump frequency (flow rate of the treatment liquid) and the like have to be adapted to the conditions of the anodic oxidation treatment.

Next, procedure(s) of the plating pretreatment (electrolytic etching treatment, anodic oxidation treatment) will be described.

After the end of the cylinder inner wall surface 3 of each cylinder 2 of the cylinder block 1 mounted in the plating pretreatment apparatus that is closer to the head surface 4 is sealed with the seal ring 21, and the end thereof closer to the crank case surface 5 is sealed with the seal jig 13 as shown in FIG. 3, the controller 62 opens any relevant connection switch valves 106 and drives their respective associated liquid feed pumps 24.

The controller 62 adjusts the number of revolutions of the liquid feed pumps 24 to achieve the flow rate of the treatment liquid flowing through the treatment liquid pipes 23A to the value set in default setting. Besides, the inlet thermometer 107 measures the inlet temperature of the treatment liquid flowing into each cylinder 2 of the cylinder block 1, and the controller 62 adjusts the temperature of the treatment liquid in the chemical tank 25 to make the measurement value equal to a predetermined value.

After the liquid feed pumps 24 introduce the treatment liquid from the chemical tank 25 into the cylinders 2 of the cylinder block 1, and the gap flow channel 27 between the cylinder inner wall surface 3 of each cylinder 2 and the electrode 12 (FIG. 3) is filled with the treatment liquid, the controller 62 makes the power supply devices 30 supply electricity to the cylinder block 1 and the electrodes 12 in their respective associated cylinders 2 in such a manner that the electrode 12 in each cylinder 2 serves as a negative electrode, and the cylinder block 1 serves as a positive electrode. The supplied current or voltage is controlled by each power supply device 30 in real time, and the plating pretreatment of the cylinder inner wall surface 3 of each cylinder 2 is separately performed.

The outlet thermometer 108 measures the outlet temperature of the treatment liquid flowing out of each cylinder 2. If any of the measurement values obtained by the outlet thermometer 108 lies outside the range between the upper control limit and the lower control limit, the controller 62 increases or decreases the number of revolutions of the liquid feed pump 24 associated with the relevant cylinder 2 to adjust the flow rate of the treatment liquid, thereby making the temperature of the treatment liquid uniform among the cylinders 2, and thus, making the plating pretreatment uniform among the cylinders 2.

For example, if the outlet temperature of the treatment liquid flowing out of a cylinder 2 measured by the outlet thermometer 108 is higher than the upper control limit, the controller 62 increases the number of revolutions of the liquid feed pump 24 associated with the cylinder 2 to increase the flow rate of the treatment liquid, thereby decreasing the temperature of the treatment liquid in the cylinder 2, and thus, reducing the reaction of the plating pretreatment.

In the case where the outlet temperature of the treatment liquid flowing out of the cylinder 2 does not fall within the range between the upper control limit and the lower control limit even after the flow rate of the treatment liquid is adjusted by increasing or decreasing the number of revolutions of the liquid feed pump 24 as described above, the controller 62 controls the power supply device 30 associated with the cylinder 2 to control the current or voltage supplied from the power supply device 30 to the cylinder block 1 and the electrode 12 in the cylinder 2, thereby making the plating pretreatment uniform among the cylinders 2.

For example, if the outlet temperature of the treatment liquid flowing out of a cylinder 2 is equal to or higher than a predetermined value higher than the upper control limit, the controller 62 controls the power supply device 30 associated with the cylinder 2 to decrease the current or voltage supplied from the power supply device 30 to the cylinder block 1 and the electrode 12 in the cylinder 2, thereby reducing the reaction of the plating pretreatment of the cylinder inner wall surface 3 of the cylinder 2.

The controller 62 may have a configuration to be able to previously set, for each cylinder, the value of the current or voltage supplied from the power supply device 30 associated with each cylinder 2 to the cylinder block 1 and the electrode 12 in the cylinder 2 and set the value of the flow rate of the treatment liquid fed by the liquid feed pump 24 to each cylinder 2 based on the characteristics of each cylinder 2 previously found by a preliminary experiment or the like.

For example, for the V-type six-cylinder cylinder block 1, the plating pretreatment (electrolytic etching, for example) of the cylinders 2 at the middle positions (cylinders #3 and #4) interposed between the other cylinders 2 at the end positions is excessive because the temperature of the cylinders 2 at the middle positions more easily increases. To solve this defect or problem, the value of the flow rate of the treatment liquid to the cylinders 2 at the middle positions is set higher than the value for the other cylinders 2, or the value of the current or voltage supplied to the cylinders 2 at the middle positions is previously set lower than the value for the other cylinders 2.

Furthermore, the controller 62 may have a configuration to determine which cylinder 2 involves the abnormality and stop the plating pretreatment of the cylinder 2 while continuing the plating pretreatment of the other cylinders 2, when an abnormality occurs and is found in the current or voltage supplied from a power supply device 30 to the cylinder block 1 and the electrode 12 housed in its associated cylinder 2 or in the flow rate of the treatment liquid fed by a liquid feed pump 24 to its associated cylinder 2. In this case, the plating pretreatment of the cylinder 2 that involves the abnormality is performed again later.

According to this embodiment, the following advantageous effects or functions (1) to (5) are provided.

(1) The power supply device 30 is provided for each cylinder 2 of the cylinder block 1 installed in the plating pretreatment apparatus, and the current or voltage supplied from the power supply device 30 to the cylinder block 1 and the electrode 12 in each cylinder 2 can be separately adjusted for each cylinder 2. In addition, the liquid feed pump 24 is provided for each cylinder of the cylinder block 1, and the flow rate of the treatment liquid fed by the liquid feed pump 24 to each cylinder 2 can be separately adjusted for each cylinder 2. Therefore, even when the electrical resistance or the resistance of the treatment liquid flow path varies among the cylinders, the plating pretreatment of the cylinder inner wall surfaces 3 of the plurality of cylinders 2 can be uniformly performed.

(2) The power supply devices 30 perform the feedback control of the current or voltage to be supplied based on the measurement value of the current or voltage supplied to the cylinder block 1 and the electrodes 12 housed in the plurality of cylinders 2 in the plating pretreatment. Therefore, the current or voltage supplied to the cylinders 2 can be controlled separately for each cylinder 2 in real time. As a result, the plating pretreatment of the cylinder inner wall surfaces 3 of the cylinders 2 can be uniformly performed.

(3) The controller 62 adjusts the flow rate of the treatment liquid fed by the liquid feed pump 24 to each cylinder 2 based on the measurement value of the outlet temperature of the treatment liquid flowing out of the cylinder 2 in the plating pretreatment. Therefore, a difference in temperature of the treatment liquid among the cylinders 2 that occurs in the plating pretreatment can be eliminated in real time. As a result, the plating pretreatment of the cylinder inner wall surfaces 3 of the cylinders 2 can be uniformly performed.

(4) In the case where the difference in electrical resistance or resistance of the treatment liquid flow path among the cylinders 2 is previously known, the controller 62 can previously set, for each cylinder 2, the value of the current or voltage supplied from the power supply devices 30 and the value of the flow rate of the treatment liquid fed by the liquid feed pumps 24. In this case, the time required for stabilization by the feedback control, for example, the time required to stabilize the voltage or current supplied to each cylinder 2 or the outlet temperature of the treatment liquid flowing out of each cylinder 2 to a desired value, can be reduced. Therefore, the uniformity of the plating pretreatment among the plurality of cylinders 2 can be further improved.

(5) When an abnormality is found in the current or voltage supplied from the power supply device 30 to the cylinder block 1 and the electrode 12 housed in its associated cylinder 2 or in the flow rate of the treatment liquid fed by a liquid feed pump 24 to its associated cylinder 2, the controller 62 determines which cylinder 2 involves the abnormality and stops the plating pretreatment of the cylinder 2 while continuing the plating pretreatment of the other cylinders 2. In addition, the plating pretreatment of the cylinder 2 that involves the abnormality is performed again later. As a result, the cylinder block 1 that would otherwise be a defective can be recovered, and the rejection rate can be reduced.

It is further to be noted that although the present invention has been described with reference to the preferred embodiment, the present invention is not limited to this embodiment, and many other changes and modifications may be made without departing from the scopes of the appended claims.

For example, in the embodiment described above, the treatment liquid is supplied from the single chemical tank 25 to the plurality of cylinders 2 of the cylinder block 1 installed in the plating pretreatment apparatus. However, the chemical tank 25 serving as a treatment liquid tank may be provided for each of the plurality of cylinders 2, and the treatment liquid may be supplied from each chemical tank 25 to its associated cylinder 2. In this case, the concentration and temperature may be set for each of the cylinders 2 of the cylinder block 1. Therefore, even when the cylinders 2 have different characteristics, the uniformity of the plating pretreatment of the cylinder inner wall surfaces 3 of the cylinders 2 may be further improved.

Furthermore, in the embodiment described above, both the power supply device 30 and the liquid feed pump 24 are provided for each of the plurality of cylinders 2 of the cylinder block 1 installed in the plating pretreatment apparatus. However, either one of the power supply device 30 or the liquid feed pump 24 may be provided for each cylinder 2.

Furthermore, in the embodiment described above, although the cylinder block 1 is a V-type six-cylinder cylinder block, the cylinder block 1 may be another V-type multi-cylinder block or a tandem multi-cylinder block.

Still furthermore, in the embodiment described above, although the plating pretreatment has been described, the present invention may be applied to a plating apparatus.

What is claimed is:

1. A plating pretreatment apparatus for a multi-cylinder block having a plurality of cylinders that performs a plating pretreatment of a cylinder inner wall surface of each of the cylinders using an electrode that is positioned so as to oppose the cylinder inner wall surface by sealing one end of the cylinder inner wall surface and introducing a treatment liquid to the cylinder inner wall surface, the plating pretreatment apparatus comprising:

an apparatus main body placed on a pedestal and provided with a workpiece mount on which the cylinder block is mounted;

a workpiece holding jig to which an air joint is mounted;

a power supply device that is provided for each of the cylinders and supplies electricity to the cylinder block and the electrode, measures the current or voltage to be supplied based on a measurement value in the plating pretreatment;

a liquid feed pump that is provided for each of the cylinders and feeds the treatment liquid into a gap between the cylinder inner wall surface and the electrode, at least one of the power supply and the liquid feed pump being provided for each of the cylinders;

a controller that control the flow rate of the treatment liquid fed by the liquid feed pump based on a measurement value of an outlet temperature of the treatment liquid flowing out of each of the cylinders in the plating pretreatment; and a seal jig that is attached to an upper end portion of the electrode and seals one end side of the inner wall of each cylinder inner wall so as to form a treatment space for each cylinder, wherein after the electrode is inserted into the cylinder of the cylinder block so as to make the air joint abut against the seal jig, the end of the cylinder inner wall surface closer to the crankcase surface being the one end of the cylinder inner wall surface is sealed.

2. The plating pretreatment apparatus for a multi-cylinder block according to claim 1, wherein the controller is configured to previously set the value of the current or voltage supplied from the power supply device and the value of the flow rate of the treatment liquid fed by the liquid feed pump for each cylinder.

3. The plating pretreatment apparatus for a multi-cylinder block according to claim 1, wherein the controller is configured to identify a cylinder that involves an abnormality occurring in the current or voltage supplied from the power supply device or the flow rate of the treatment liquid fed by the liquid feed pump and stop the plating pretreatment of the cylinder that involves the abnormality while continuing the plating pretreatment of the other cylinders.

4. The plating pretreatment apparatus for a multi-cylinder block according to claim 1, wherein a treatment liquid tank that stores the treatment liquid is provided for each cylinder.

5. A plating pretreatment apparatus for a multi-cylinder block, comprising:

an apparatus main body placed on a pedestal and including a work workpiece mount on which a cylinder block is mounted;

a workpiece holding jig to which an air joint is mounted;

an electrode supported by an electrode support provided for the apparatus main body;

a treatment liquid supply member for supplying a treatment liquid in a gap formed between a cylinder inner wall surface and an outer wall surface of the electrode and in an inside of the cylindrical electrode, the treatment liquid supply member including a liquid feed pump;

a power supply member for flowing electricity to the electrode and the cylinder block; and a seal member for sealing one end side of the cylinder inner wall surface, wherein at least one of the power supply member and a liquid feed pump that feeds the treatment liquid into a gap between the cylinder inner wall surface and the electrode is provided for each of the cylinders, wherein the seal member is attached to an upper end portion of the electrode and seals one end side of an inner wall of each cylinder inner wall so as to form a treatment space for each cylinder, and wherein, after the electrode is inserted into the cylinder of the multi-cylinder block so as to make an air joint abut against the seal member, the end of the cylinder inner wall surface closer to the crankcase surface being the one end of the cylinder wall surface is sealed.

6. A plating pretreatment apparatus for a multi-cylinder block according to claim 5, further comprising a controller that controls the flow rate of the treatment liquid fed by the liquid feed pump based on a measurement value of an outlet temperature of the treatment liquid flowing out of each of the cylinders in the plating pretreatment.

* * * * *